US009806451B2

(12) United States Patent
Ono

(10) Patent No.: US 9,806,451 B2
(45) Date of Patent: Oct. 31, 2017

(54) CONNECTOR AND CONTACTS ASSEMBLY

(75) Inventor: Masahiro Ono, Okayama (JP)

(73) Assignee: OMRON Corporation, Kyoto (JP)

( * ) Notice: Subject to any disclaimer, the term of this patent is extended or adjusted under 35 U.S.C. 154(b) by 215 days.

(21) Appl. No.: 14/123,285

(22) PCT Filed: Mar. 14, 2012

(86) PCT No.: PCT/JP2012/056570

§ 371 (c)(1),
(2), (4) Date: Apr. 11, 2014

(87) PCT Pub. No.: WO2012/172845

PCT Pub. Date: Dec. 20, 2012

(65) Prior Publication Data

US 2014/0302724 A1 Oct. 9, 2014

(30) Foreign Application Priority Data

Jun. 15, 2011 (JP) ..... 2011-133531

(51) Int. Cl.
*H01R 4/50* (2006.01)
*H01R 13/42* (2006.01)
(Continued)

(52) U.S. Cl.
CPC ..... *H01R 13/42* (2013.01); *H01R 13/4364* (2013.01); *H01R 13/502* (2013.01); *H01R 24/86* (2013.01)

(58) Field of Classification Search
CPC ..... H01R 13/625; H01R 9/092
(Continued)

(56) References Cited

U.S. PATENT DOCUMENTS 2,419,018 A * 4/1947 Gudie ..... H01R 13/426 174/21 JS
7,390,222 B2 * 6/2008 Ciancanelli ..... C02F 1/325 250/436
(Continued)

FOREIGN PATENT DOCUMENTS

DE 3940230 A1 6/1991
DE 202005017981 U1 2/2006
(Continued)

OTHER PUBLICATIONS

International Search Report for corresponding application PCT/JP2012/056570 filed Mar. 14, 2012; dated May 29, 2012.
(Continued)

*Primary Examiner* — Phuong Chi T Nguyen
(74) *Attorney, Agent, or Firm* — Klarquist Sparkman, LLP

(57) ABSTRACT

A connector, including a plug terminal of a plug connected to a first electric signal line and inserted in a terminal hole of a plug body, a socket terminal of a socket connected to a second electric signal line and inserted in a terminal hole of a socket body, a plug holder of the plug, and a socket holder of the socket, where the plug holder and the socket holder are connected to each other, where the plug terminal is press fitted in and electrically connected to the socket terminal, where a position in an axial center direction is controlled by sandwiching one end portion of at least one of the plug terminal and the socket terminal between the body and a terminal holder made of an insulating material.

10 Claims, 19 Drawing Sheets

(51) Int. Cl.
*H01R 13/436* (2006.01)
*H01R 13/502* (2006.01)
*H01R 24/86* (2011.01)

(58) Field of Classification Search
USPC ..... 439/332, 333, 337, 680, 188, 585, 751
See application file for complete search history.

(56) References Cited

U.S. PATENT DOCUMENTS

| | | | | |
|---|---|---|---|---|
| 2002/0126457 | A1* | 9/2002 | Kameyama ..... | H01R 13/6658 361/728 |
| 2003/0199205 | A1 | 10/2003 | Kosmala | |
| 2005/0136723 | A1* | 6/2005 | Dilliner ..... | H01R 24/28 439/320 |
| 2005/0239311 | A1 | 10/2005 | Yokoigawa et al. | |
| 2006/0035513 | A1 | 2/2006 | Yohn | |
| 2007/0141908 | A1* | 6/2007 | Bert ..... | H01R 4/2441 439/607.05 |
| 2008/0096421 | A1 | 4/2008 | Hass | |
| 2008/0124983 | A1 | 5/2008 | Sundermeier | |
| 2010/0178812 | A1 | 7/2010 | Thelen | |

FOREIGN PATENT DOCUMENTS

| | | |
|---|---|---|
| JP | 2008130556 A | 6/2008 |
| WO | 2011013747 | 2/2011 |

OTHER PUBLICATIONS

European Search Report for corresponding application EP12799825; dated Sep. 24, 2014.

* cited by examiner

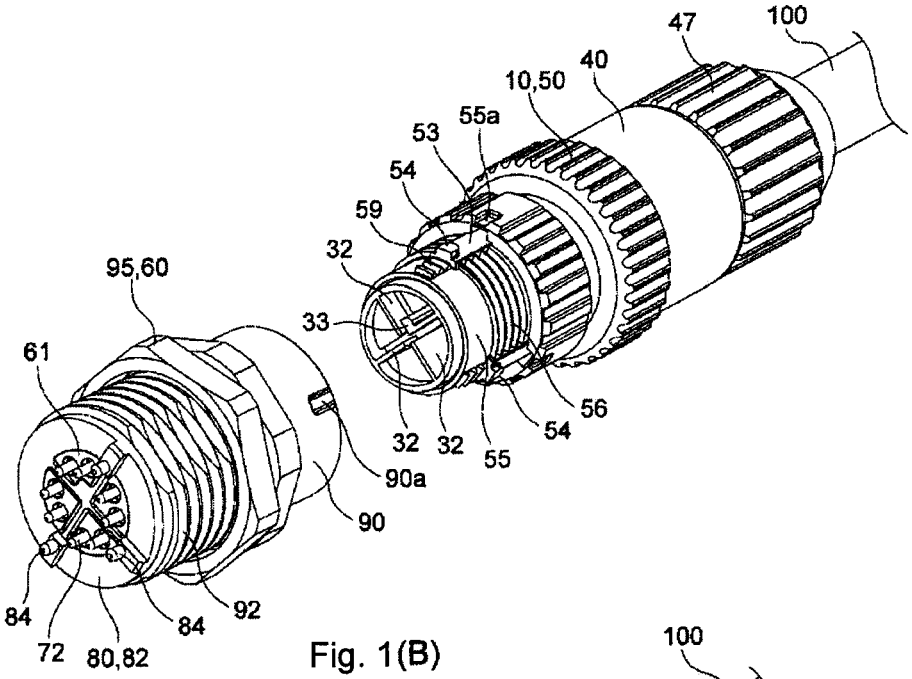
Fig. 1(B)
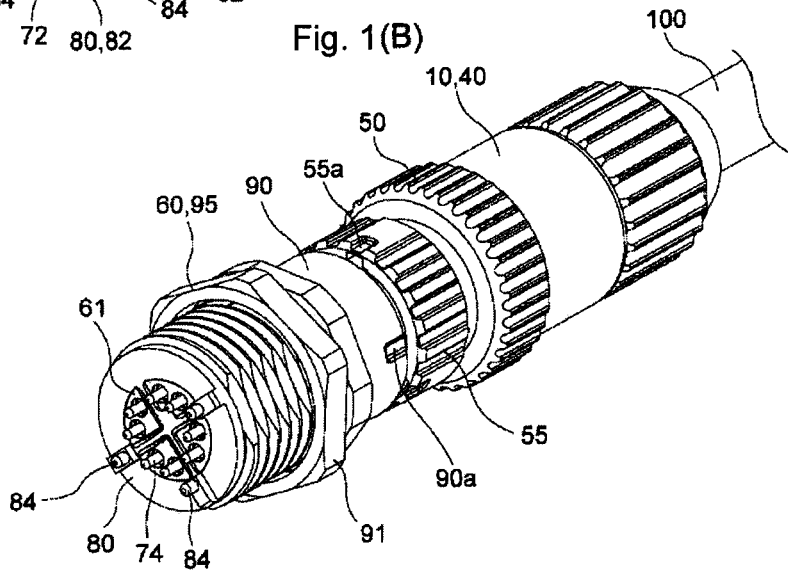

Fig. 12

■ PBT analysis result

| Category | Frequency [MHz] | Specification-value insertion loss [dB] | Analysis value [dB] | | | | | |
|---|---|---|---|---|---|---|---|---|
| | | | With space [1] | With space [2] | With space [3] | With space [4] | With space [5] | Without space |
| Cat5 | 100 | 0.4 or less | 0.04 | 0.03 | 0.05 | 0.05 | 0.05 | 0.05 |
| Cat6 | 250 | 0.32 or less | 0.08 | 0.09 | 0.11 | 0.12 | 0.14 | 0.15 |
| Cat7 | 600 | 0.49 or less | 0.26 | 0.34 | 0.37 | 0.42 | 0.52 | 0.56 |

■ LCP analysis result

| Category | Frequency [MHz] | Specification-value insertion loss [dB] | Analysis value [dB] | | | | | |
|---|---|---|---|---|---|---|---|---|
| | | | With space [1] | With space [2] | With space [3] | With space [4] | With space [5] | Without space |
| Cat5 | 100 | 0.4 or less | 0.04 | 0.03 | 0.05 | 0.05 | 0.05 | 0.05 |
| Cat6 | 250 | 0.32 or less | 0.08 | 0.10 | 0.12 | 0.13 | 0.14 | 0.15 |
| Cat7 | 600 | 0.49 or less | 0.26 | 0.38 | 0.42 | 0.47 | 0.52 | 0.56 |

■ PPS analysis result

| Category | Frequency [MHz] | Specification-value insertion loss [dB] | Analysis value [dB] | | | | | |
|---|---|---|---|---|---|---|---|---|
| | | | With space [1] | With space [2] | With space [3] | With space [4] | With space [5] | Without space |
| Cat5 | 100 | 0.4 or less | 0.04 | 0.04 | 0.04 | 0.04 | 0.05 | 0.05 |
| Cat6 | 250 | 0.32 or less | 0.08 | 0.10 | 0.12 | 0.12 | 0.14 | 0.15 |
| Cat7 | 600 | 0.49 or less | 0.26 | 0.35 | 0.43 | 0.45 | 0.52 | 0.56 |

■Analysis result

| Category | Frequency band [MHz] | Specification-value near-end crosstalk [dB] | Analysis value [dB] | | | | | |
|---|---|---|---|---|---|---|---|---|
| | | | pair1/2⇒3/4 | | pair1/2⇒5/6 | | pair1/2⇒7/8 | |
| | | | Equilibrium | Non-equilibrium | Equilibrium | Non-equilibrium | Equilibrium | Non-equilibrium |
| Cat5 | 100 | 43 or more | 95.2 | 74.6 | 116.4 | 86.1 | 95.4 | 74.6 |
| Cat6 | 250 | 46 or more | 87.5 | 65.7 | 108.7 | 77.2 | 87.6 | 65.7 |
| Cat7 | 600 | 60.7 or more | 81.2 | 55.3 | 102.2 | 66.7 | 81.4 | 55.3 |

CONNECTOR AND CONTACTS ASSEMBLY

CROSS REFERENCE TO RELATED APPLICATION

This application, filed under 35 U.S.C. 371, is the national stage of, and claims the benefit of, International Patent Applicant Number PCT/JP2012/056570 filed on 14 Mar. 2012, which claims priority to Japanese Patent Application Number 2011-133531 filed on 15 Jun. 2011, the contents of both of said applications are herein incorporated by reference in their entirety.

TECHNICAL FIELD

The present invention relates to a connector, particularly to a high frequency connector including a shield function of being able to prevent an external noise and an internal noise of a high frequency signal in a high frequency band.

BACKGROUND ART

A plug connector for a conductor is known which connects a multi-core individual conductor in which one end is firmly coupled to a pin contact or a socket contact. As seen for example in Japanese Unexamined Patent Publication No. 2008-130556, the connector consists of a pin contact or socket contact (40) including an individual conductor (46) inserted in a contact chamber (31), which is oriented along a retention body (30) and opened halfway, the retention body (30) is inserted in a connector sleeve (3) surrounding the retention body (30), the connector sleeve (3) is constructed by a first connector portion (10) and a second connector portion (15), both the connector portions (10, 15) are disposed on a retention sleeve (20) opened on both sides, and the pin contact or socket contact (40) oriented in the contact chamber (31) of the retention body (30) is fixed using a longitudinal rib (24) properly disposed in the retention sleeve (20).

However, in the above connection structure, as illustrated in FIGS. 1 and 2 of Japanese Unexamined Patent Publication No. 2008-130556, the pin contact 40 is connected to a lead wire of a cable 44 and is supported by the retention body 30 while assembled one by one from an outer circumferential surface side. Therefore, unfortunately, the positions of the pin contacts 40 are easily deviated from each other in an axial center direction, a desired high frequency property is hardly obtained, and it takes a lot of time to adjust the positions of the pin contacts 40.

In view of the foregoing, a connector is desired, in which the positioning of the terminal is accurately and easily performed and the desired high frequency property is obtained.

SUMMARY OF INVENTION

A connector is provided including a plug terminal of a plug connected to a first electric signal line and inserted in a terminal hole of a plug body, a socket terminal of a socket connected to a second electric signal line and inserted in a terminal hole of a socket body, a plug holder of the plug, and a socket holder of the socket, where the plug holder and the socket holder are connected to each other, where the plug terminal is press fitted in and electrically connected to the socket terminal, where a position in an axial center direction is controlled by sandwiching one end portion of at least one of the plug terminal and the socket terminal between the body and a terminal holder made of an insulating material.

BRIEF DESCRIPTION OF THE DRAWINGS

FIGS. 1(A) and 1(B) are perspective views illustrating before and after a socket and a plug which constitute a connector according to the present invention are connected to each other.

FIG. 12 is tables illustrating an analysis result of a high frequency property.

DETAILED DESCRIPTION

A connector according to an embodiment of the present invention will be described with reference to FIGS. 1(A) to 11(B).

As illustrated in FIGS. 1(A) to 2(B), a connector includes a bayonet plug 10 and a bayonet socket 60.

Figure 2:
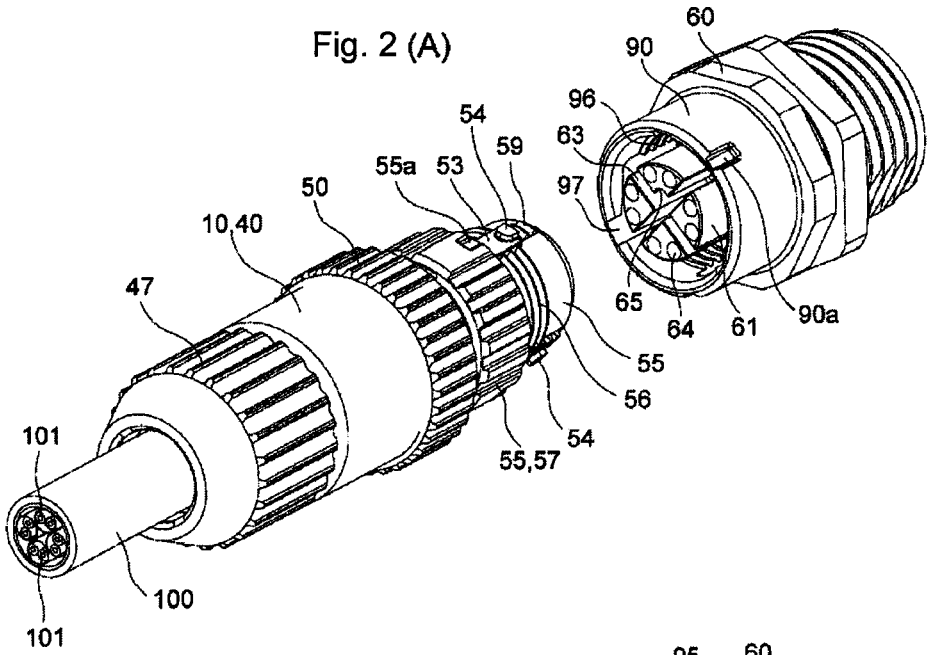
FIGS. 2(A) and 2(B) are perspective views before and after the plug and the socket in FIGS. 1(A) and 1(B) are connected to each other when viewed from a different angle.
Figure 2:
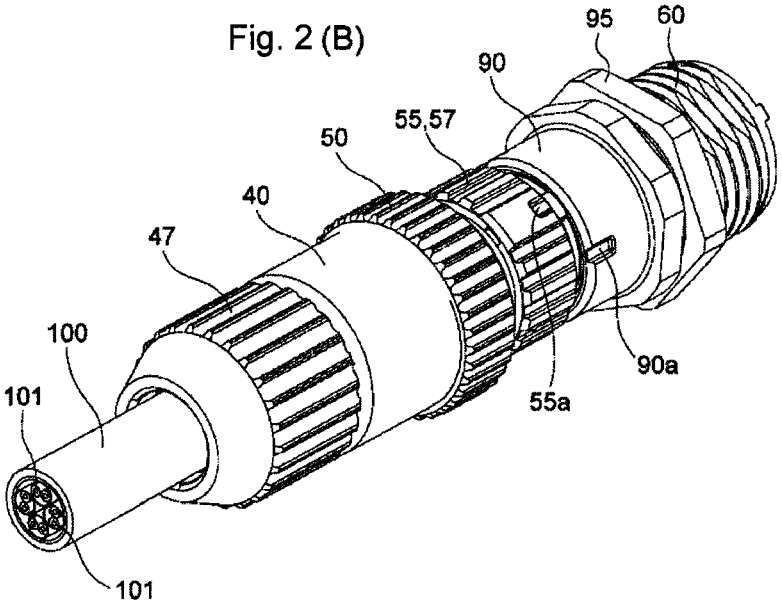
Figure 3:
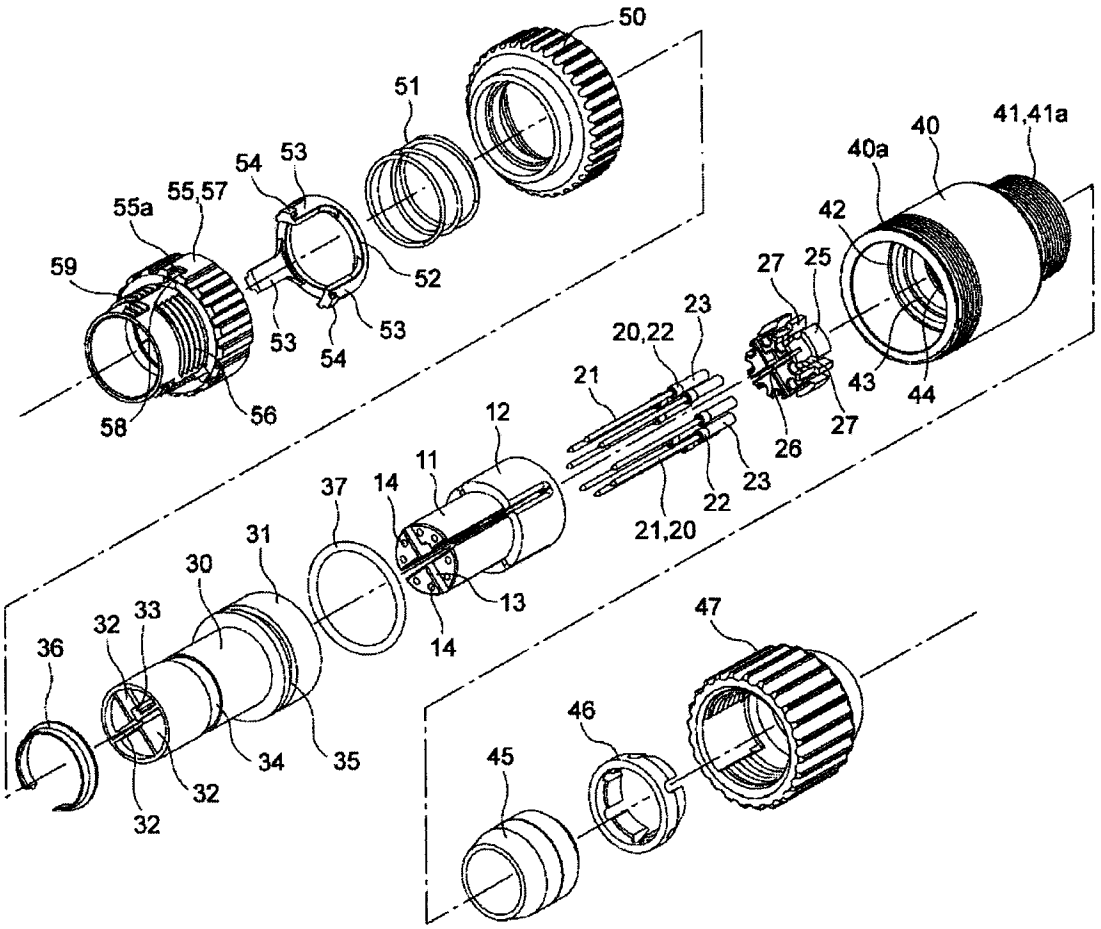
FIG. 3 is an exploded perspective view of the plug in FIGS. 1(A) and 1(B).
Figure 4:
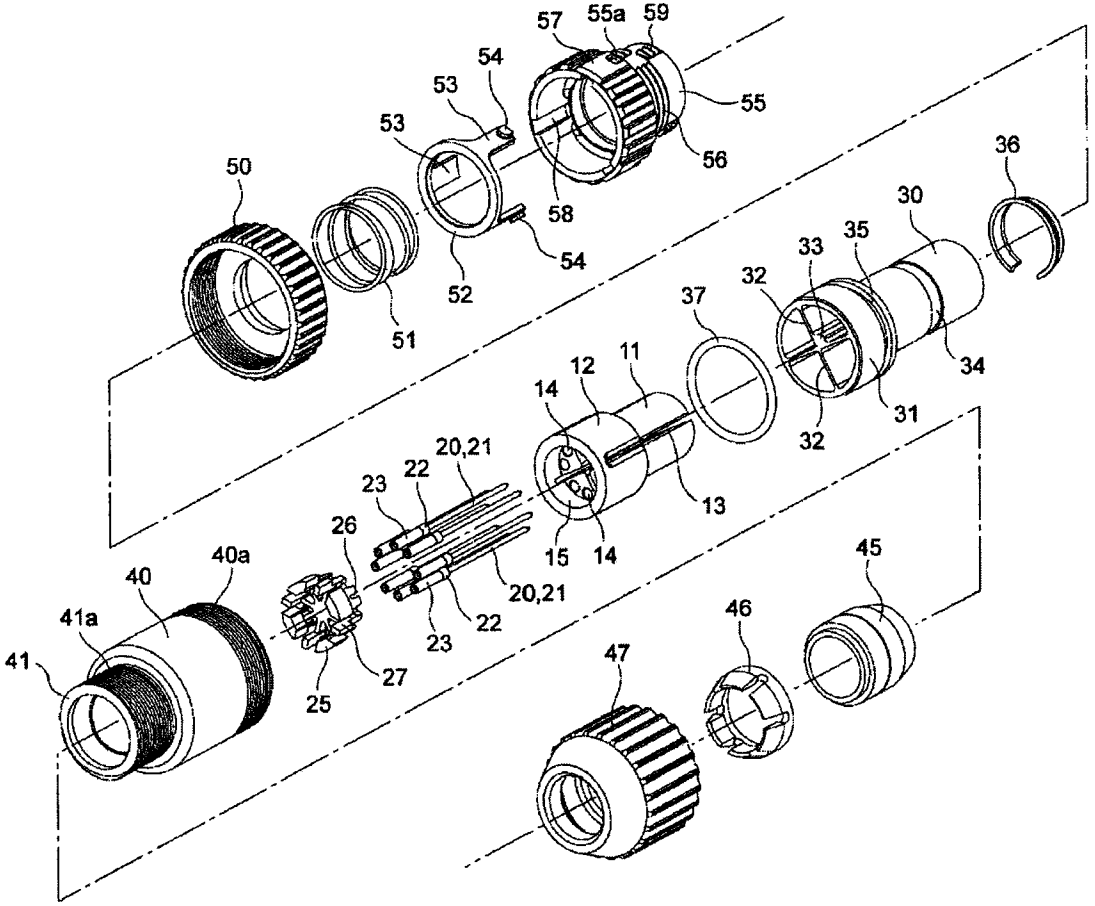
FIG. 4 is an exploded perspective view of the plug in FIGS. 2(A) and 2(B).

As illustrated in FIGS. 3 and 4, the bayonet plug 10 includes a plug body 11, a total of eight plug terminals 20 including four sets of two plug terminals 20, a plug terminal holder 25, a shield member 30, a cylindrical housing 40, a fastening tool 47, a ring cover 50, a coil spring 51, a stopper tool 52, and a plug holder 55.

Figure 8:
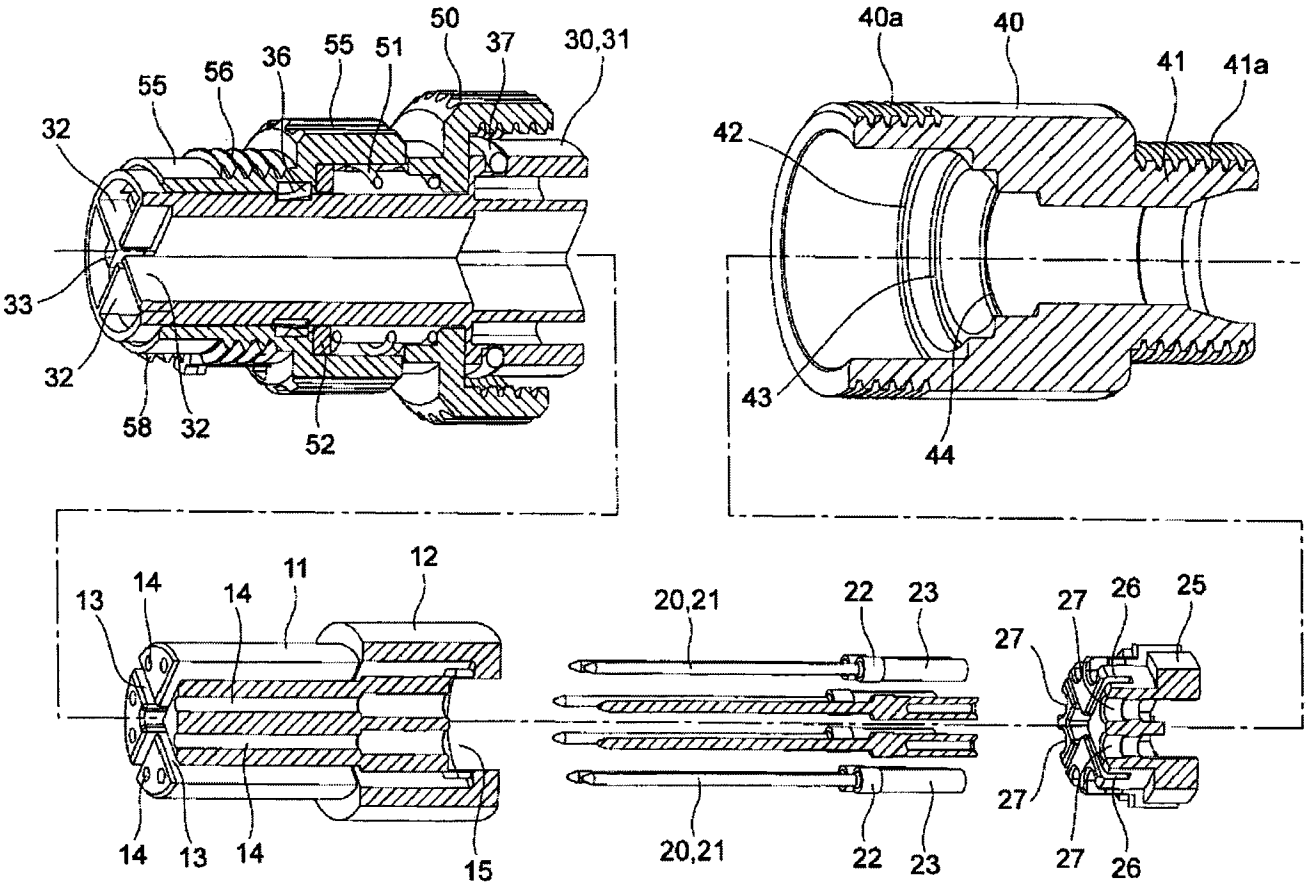
FIG. 8 is a partially sectional exploded perspective view of the plug in FIGS. 1(A) and 1(B).
Figure 9:
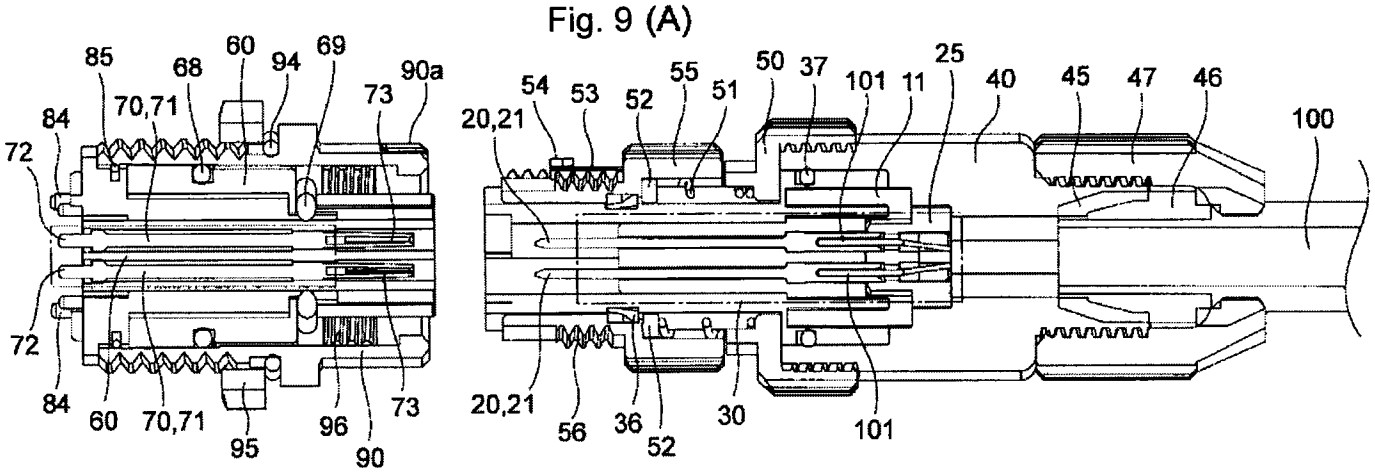
FIG. 9(A) is a sectional view before the socket and the plug in FIGS. 1(A) and 1(B) are connected to each other.
FIGS. 9(B) and 9(C) are partially enlarged views illustrating the plug and the socket in FIG. 9(A).
Figure 9:
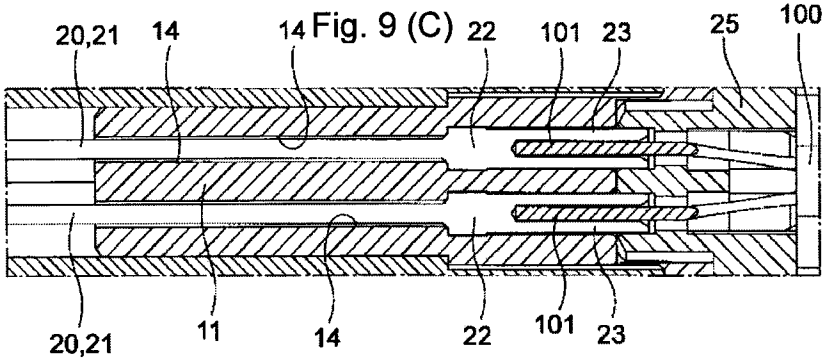
Figure 9:
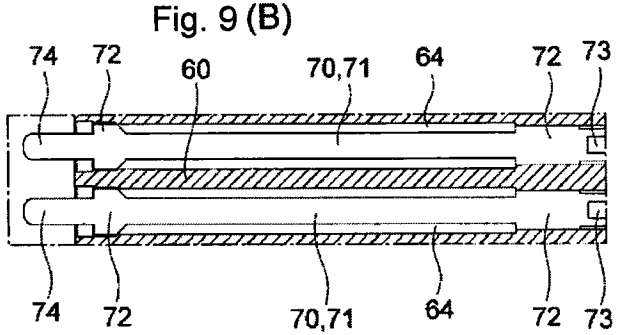
Figure 10:
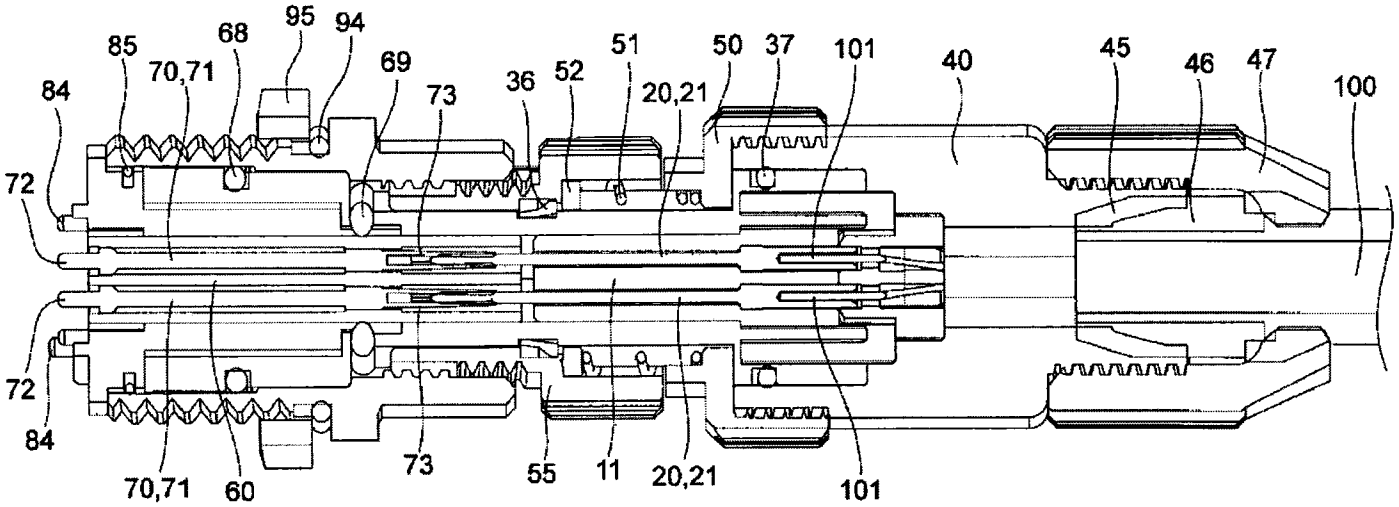
FIG. 10 is a sectional view after the socket and the plug in FIGS. 1(A) and 1(B) are connected to each other.
Figure 11B:
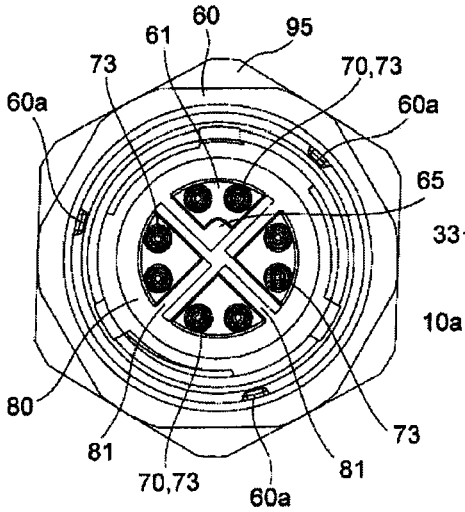
FIGS. 11(A) and 11(B) are front views illustrating opposed surfaces of the plug and the socket.
Figure 11:
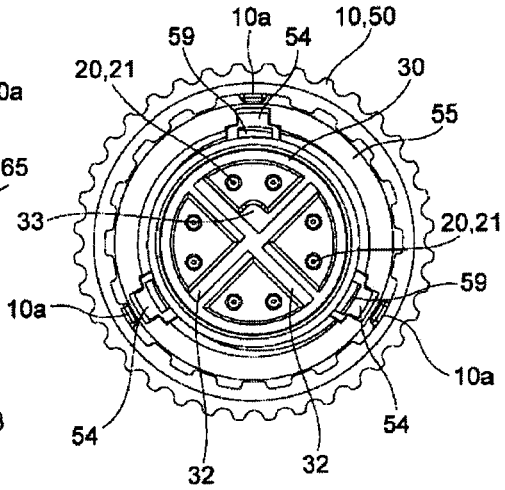

As illustrated in FIG. 8, the plug body 11 is a step columnar resin molding including a large diameter portion 12, and a set of two terminal holes 14 is made in each of four areas that are partitioned by a cross slit 13 provided along an axial center. At least one of PBT (polybutylene terephthalate), LCP (liquid crystal polymer), and PPS (polyphenylene sulfide) can be used as a material for the plug body 11. A fitting recess 15, in which the plug terminal holder 25 to be described later can be fitted, is provided in an end face of the large diameter portion 12 (see FIG. 4).

As illustrated in FIG. 8, a pin terminal portion 21, that is of a transmission line portion inserted in the terminal hole 14 of the plug body 11, is provided on one end side of the plug terminal 20 while a connection portion 23 is provided on the other end side with a circular step portion 22 interposed therebetween. A lead wire 101 of an electric signal cable 100, to be described later, can be electrically connected to the connection portion 23.

In the electric signal cable 100, the eight lead wires 101 are coated with an insulating resin in units of a set of two lead wires 101, and also coated with an aluminum foil (not illustrated) and a mesh shield line (not illustrated). The lead wire 101 is electrically connected to the connection portion 23 of the plug terminal 20 by pressure bonding and/or soldering (see FIGS. 9(A) to 10).

As illustrated in FIG. 8, the plug terminal holder 25 has an outer circumferential shape that can be fitted in the fitting recess 15 of the plug body 11, and a set of two terminal notch holes 27 is made in each of four areas that are partitioned by a cross slit 26 provided along the axial center. Particularly, the terminal notch hole 27 has a sectional shape that is fitted in an end portion of the connection portion 23 of the plug terminal 20 to be able to control a position in the axial center direction (see FIGS. 9(A) and 10).

As illustrated in FIG. 3, the shield member 30 is a molding made of a step cylindrical conductive member including a large diameter portion 31, and partitioned into four spatial areas by a cross partition wall 32 provided along the axial center. A guiding ridge 33 is provided in a center portion of the cross partition wall 32. A circular groove portion 34 with which a conductive C-ring 36 can be engaged is provided in the outer circumferential surface of the shield member 30, and a circular groove portion 35 with which an elastic O-ring 37 can be engaged is provided in the outer circumferential surface of the large diameter portion 31. The conductive C-ring 36 has a sectional shape that not only is engaged with the circular groove portion 34 to electrically connect the plug holder 55 (to be described later) and the shield member 30, but also can stop the plug holder 55.

As illustrated in FIG. 8, the cylindrical housing 40 is a molding. The molding has a sectional shape in which the shield member 30, having the plug body 11 disposed therein, can be accommodated. The molding comprises a cylindrical conductive member including a small diameter portion 41. An external thread portion 40*a* is provided in an outer circumferential surface edge portion on one end side of the cylindrical housing 40, and an external thread portion 41*a* is formed in the outer circumferential surface of the small diameter portion 41. A positioning first circular step portion 42, a positioning second circular step portion 43, and a positioning third circular step portion 44 are provided in an inner circumferential surface of the cylindrical housing 40.

The shield member 30 can be stopped by screwing the ring cover 50 on the external thread portion 40*a*. On the other hand, a water-proof bush 45 and a cable clamp 46 are elastically deformed by screwing the fastening tool 47 on the external thread portion 41*a*, which allows the electric signal cable 100 to be stopped.

The coil spring 51 has an inner diameter such that the shield member 30 can be fitted, and the coil spring 51 brought into contact with the stopper tool 52, to be described later, with a pressure to bias the stopper tool 52 outward.

The stopper tool 52 has a ring shape having such an inner diameter that the outer circumferential surface of the shield member 30 can be fitted, and three engagement claws 53 are protruded in parallel to the axial center with equal intervals therebetween. An engagement protrusion 54 is provided in each of leading end portions of the outer circumferential surfaces of the engagement claws 53.

The plug holder 55 has such a cylindrical shape as to rotatably fit to the shield member 30. In the plug holder 55, an external thread portion 56 is formed in a half of the outer circumferential surface on one end side, and a turning operation circular rib 57 extends from the edge portion of the outer circumferential surface on one end side. A positioning mark 55*a* is provided in the edge portion on the other end side of the turning operation circular rib 57. Three guide grooves 58 which are communicated along the outer circumferential surface of the plug holder 55 and the inner circumferential surface of the turning operation circular rib 57 are formed in parallel to the axial center with equal intervals therebetween. The engagement claw 53 of the stopper tool 52 can be inserted in each of the guide grooves 58. An external thread portion 59 is provided on the other end side of each of the guide grooves 58 in order to ensure an effective length of a screw.

A method for assembling the plug 10 will be described below.

As illustrated in FIGS. 3 and 4, the lead wires 101 of the electric signal cable 100 are electrically connected to the respective connection portions 23 of the plug terminals 20. The connection portions 23 of the plug terminals 20 are assembled in the terminal notch holes 27 of the plug terminal holder 25 by the fitting, the pin terminal portions 21 of the plug terminals 20 are inserted in the respective terminal holes 14 of the plug body 11, and the plug terminal holder 25 is fitted in the fitting recess 15 of the plug body 11. Therefore, the leading ends of the pin terminal portions 21 protrude from the plug body 11.

The plug body 11 is assembled in the shield member 30 in which the elastic O-ring 37 is mounted on the circular groove portion 35 of the large diameter portion 31. Then the ring cover 50, the coil spring 51, the stopper tool 52, and the plug holder 55 are sequentially assembled in the shield member 30. Then, the conductive C-ring 36 is engaged with the circular groove portion 34 while the plug holder 55 is pressed inwardly to compress the coil spring 51, thereby obtaining a semi-finished-product plug 10.

The semi-finished-product plug 10 is assembled in the cylindrical housing 40, and the cylindrical housing 40 is sealed by screwing the ring cover 50 on the external thread portion 40*a* of the cylindrical housing 40. On the other hand, the fastening tool 47 is screwed on the external thread portion 41*a* of the cylindrical housing 40, and the water-proof bush 45 and the clamp 46 in which the electric signal cable 100 is inserted are elastically deformed to fix the electric signal cable 100, thereby completing the assembly of the plug 10.

According to the embodiment, as illustrated in FIGS. 9(A) to 9(C), a continuous cylindrical air gap is formed between the outer circumferential surface of the pin terminal portion 21 of the plug terminal 20 and the inner circumferential surface of the terminal hole 14 of the plug body 11.

According to the embodiment, the ring cover 50 is screwed on the cylindrical housing 40 to fasten the plug body 11, the plug terminal holder 25, and the shield member 30 in the axial center direction. Therefore, even if the assembly positions in the axial center direction vary in the plug terminals 20, the plug terminal holder 25 presses the connection portions 23 of the plug terminals 20 onto the side of the plug body 11 to eliminate the variation of the assembly position. As a result, advantageously the plurality of plug terminals 20 protruding from the plug body 11 in the axial center direction can be equalized to each other in protrusion dimension.

According to the embodiment, the aluminum foil (not illustrated) and the mesh shield line (not illustrated) of the electric signal cable 100 are in contact with the cylindrical housing 40. Therefore, a shield structure is formed through the cylindrical housing 40, the ring cover 50, the shield member 30, the conductive C-ring 36, and the plug holder 55.

Figure 5:
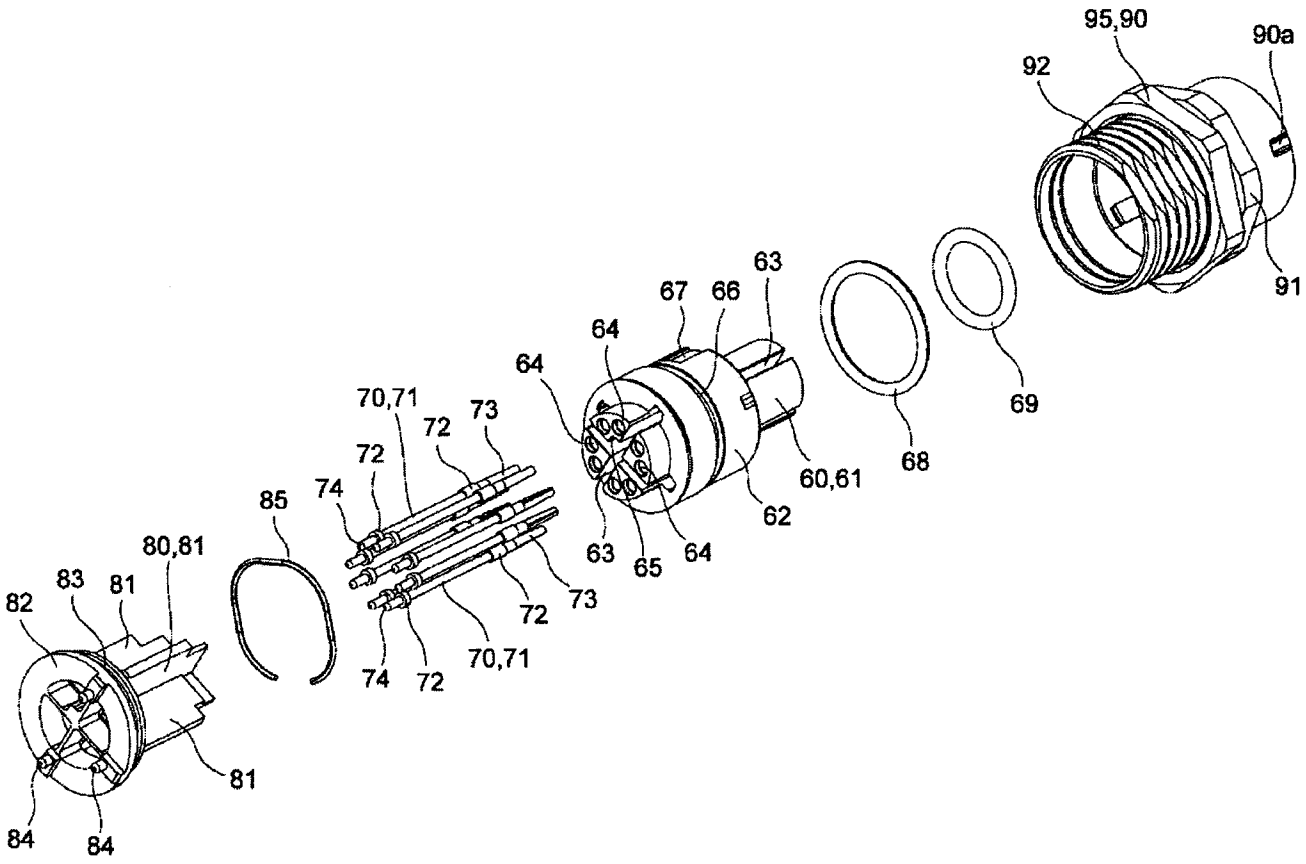
FIG. 5 is an exploded perspective view of the socket in FIGS. 2(A) and 2(B).
Figure 6:
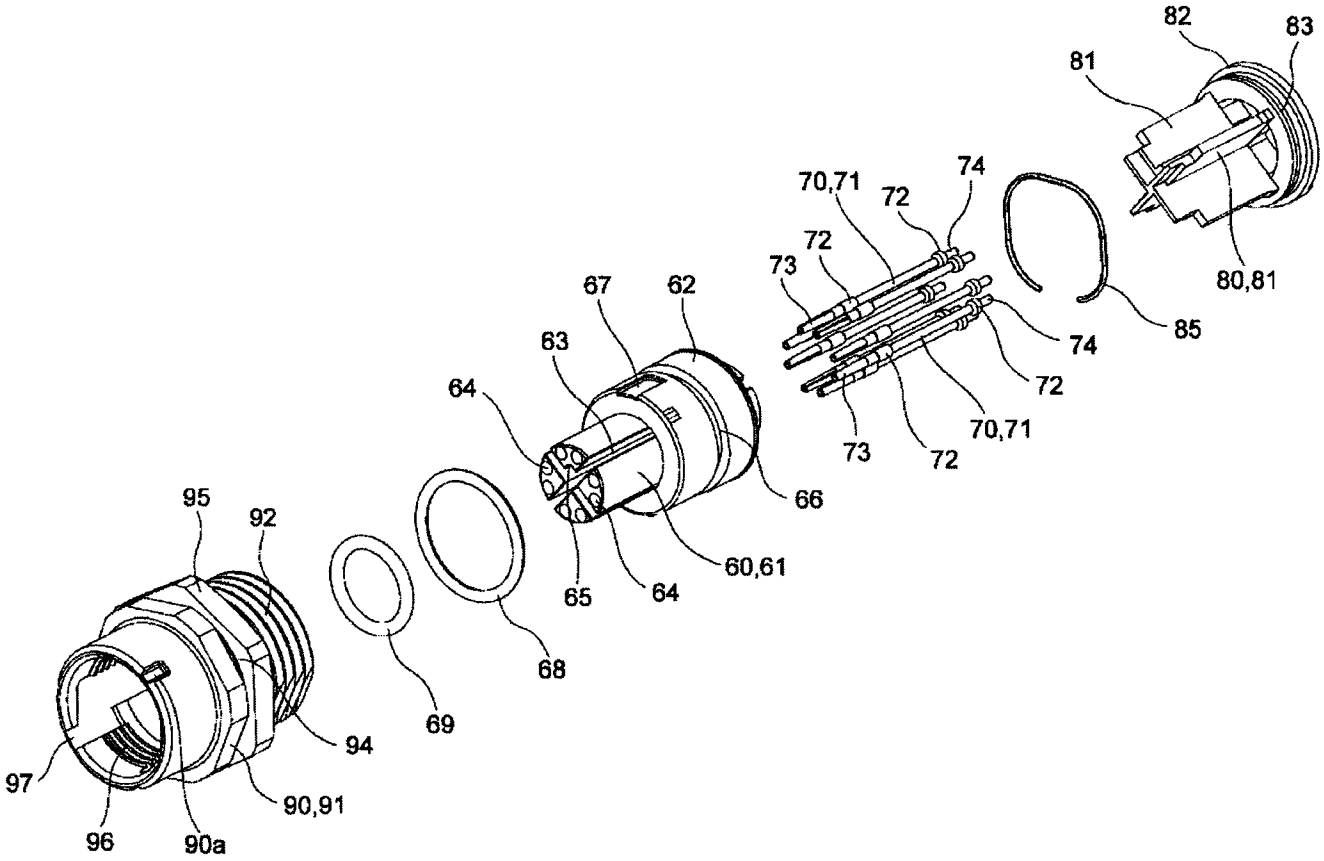
FIG. 6 is an exploded perspective view of the socket in FIGS. 1(A) and 1(B).
Figure 7:
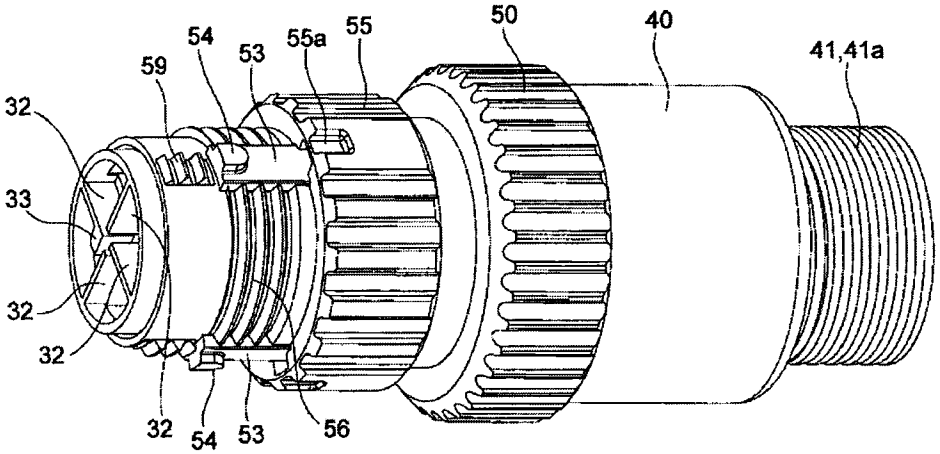
FIGS. 7(A) and 7(B) are a perspective view and a partially sectional view of the socket in FIGS. 1(A) and 1(B).
Figure 7:
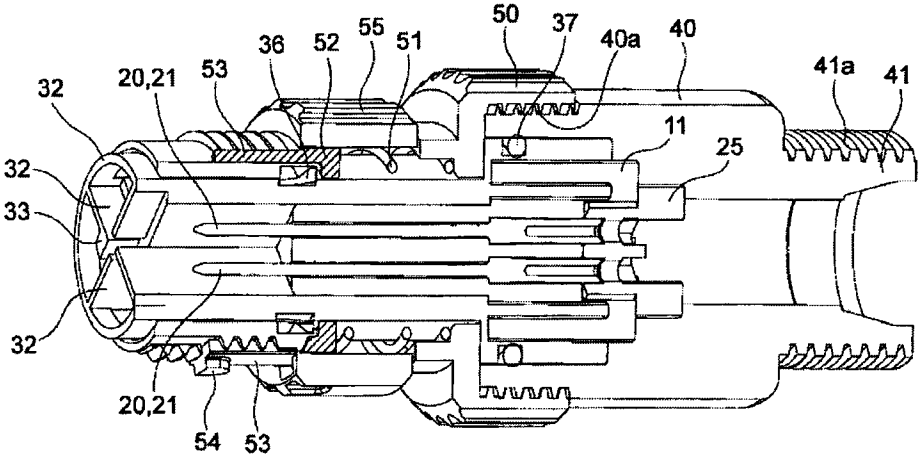

As illustrated in FIGS. 5 and 6, the bayonet socket 60 is used while attached to an attaching plate (not illustrated), and the bayonet socket 60 includes a socket body 61, socket terminals 70, a shield member 80, and a socket holder 90.

The socket body 61 is a step columnar resin molding including a large diameter portion 62, and a set of two terminal holes 64 is made in each of four areas that are partitioned by a cross slit 63 provided along the axial center. A guiding groove portion 65 is provided in the center portion of the cross slit 63. At least one of PBT (polybutylene terephthalate), LCP (liquid crystal polymer), and PPS (polyphenylene sulfide) can be used as a material for the socket body 61. A circular groove portion 66 is provided in the outer circumferential surface of the large diameter portion 62, and a notch groove 67 is provided in the edge portion of the outer circumferential surface of the large diameter portion 62. A large-diameter elastic O-ring 68 is mounted on the circular groove portion 66 of the large diameter portion 62, and a small-diameter elastic O-ring 69 is mounted on a base portion of the large diameter portion 62.

The socket terminal 70 has a shape that can be inserted in the terminal hole 64 of the socket body 61, and circular step portions 72 and 72 are provided at both ends of a transmission line portion 71. A socket portion 73 in which the pin terminal portion 21 of the plug terminal 20 can be inserted is provided on one end side of one of the circular step portions 72 and 72, and a connection portion 74 electrically connected to a circuit board (not illustrated) is provided on the other end side of the other circular step portion 72.

The shield member 80 is formed by a partition wall 81 having a cross shape in section and a cap portion 82. The partition wall 81 can be inserted in the cross slit 63 of the socket body 61, and the cap portion 82 is integrally molded on one end side of the partition wall 81. A positioning protrusion 84 protrudes from an outward-looking surface of the cap portion 82. A substantially square conductive C-ring 85 can be latched in a circular engagement groove 83 provided in the outer circumferential surface of the cap portion 82.

The socket holder 90 of FIG. 5 is made of metal and has a cylindrical shape in which the socket body 61 can be accommodated. An external thread portion 92 is formed on one side of a hexagonal fixing rib 91 provided in the substantial center of the outer circumferential surface of the socket holder 90, and a positioning mark 90*a* is provided in the edge portion on the other side of the fixing rib 91. A nut 95 is screwed on the external thread portion 92 in order to fix the attaching plate (not illustrated) with an elastic O-ring 94 (see FIGS. 9(A) to 9(C)) interposed therebetween. Additionally, as illustrated in FIG. 6, on the other side of the inner circumferential surface of the socket holder 90, a fixing internal thread portion 96 is formed, and the fixing internal thread portion 96 is notched to form a substantial L-shape engagement groove 97.

The socket holder is not necessarily fixed to the attaching plate, but the electric signal cable 100 may directly be connected.

A socket assembling method will be described below.

As illustrated in FIGS. 5 and 6, the socket terminals 70 are press-fitted in the respective terminal holes 64 of socket body 61. The conductive C-ring 85 is latched in the engagement groove 83 of the shield member 80 while the large-diameter and small-diameter elastic O-rings 68 and 69 are mounted on the socket body 61. Then the cross partition wall 81 of the shield member 80 is fitted in the cross slit 63 of the socket body 61. The socket body 61 is fitted in the socket holder 90, and the large-diameter elastic O-ring 68 is press-fitted while elastically deformed, and the cap portion 82 of the shield member 80 is press-fitted in the inner circumferential surface of the socket holder 90, thereby completing the assembly of the socket holder 90. Therefore, the large-diameter elastic O-ring 68 is elastically deformed to establish the sealing, and electric conduction is established between the shield member 80 and the socket holder 90 through the conductive C-ring 85 to form a shield structure.

According to the embodiment as illustrated in FIGS. 9(A) to 9(C), a continuous cylindrical air gap is formed between the outer circumferential surface of the transmission line portion 71 of the socket terminal 70 and the inner circumferential surface of the terminal hole 64 of the socket 60.

A method for connecting the bayonet plug 10 and the bayonet socket 60 will be described below.

As illustrated in FIGS. 1(A) to 2(B), the guiding ridge 33 of the cross partition wall 32 provided in the shield member 30 of the plug 10 is positioned and pressed in the guiding groove portion 65 of the cross slit 63 of the socket body 61. Therefore, the pin terminal portions 21 of the plug terminals 20 are inserted in and electrically connected to the socket portions 73 of the socket terminals 70. The engagement claw 53 of the stopper tool 52 biased outward by the spring force of the coil spring 51 is inserted in the substantial L-shape engagement groove 97 provided in the inner circumferential surface of the socket holder 90. When the plug holder 55 and/or the socket holder 90 is turned, the engagement protrusion 54 of the engagement claw 53 is slid along and engaged with the substantial L-shape engagement groove 97, the positioning marks 55*a* and 90*a* are matched with each other to form a locked state. The outer circumferential edge portion of the leading end surface of the shield member 30 compresses and elastically deforms the elastic O-ring 69, which allows a high waterproof property to be ensured.

Where the socket body 61 is mounted on the socket holder 90, preferably, a slight play is provided in the axial center direction with respect to the socket body 61.

As described, the invention can be applied to the bayonet plug 10 and the bayonet socket 60. Alternatively, the present invention may be applied to a conventional screw type socket and a conventional screw type plug.

In one embodiment, the bayonet socket 60 is connected to the bayonet plug 10. Alternatively, the conventional screw type plug may be connected to the bayonet socket 60 of the embodiment, or the bayonet socket 10 of the embodiment may be connected to the conventional screw type plug.

Example 1

In a first exemplary connector according to the invention, the plug body and the socket body were made of PBT (polybutylene terephthalate), LCP (liquid crystal polymer), and PPS (polyphenylene sulfide), respectively, and an insertion loss was analyzed in the case that the dimension of the continuous cylindrical air gap formed between the outer circumferential surface of the terminal and the inner circumferential surface of the terminal hole varied.

Whether the insertion loss was smaller than a specification value in category 7 (a frequency band of 1 to 600 MHz) was analyzed based on a test standard of IEC 60512-25-2.

Figure 13:
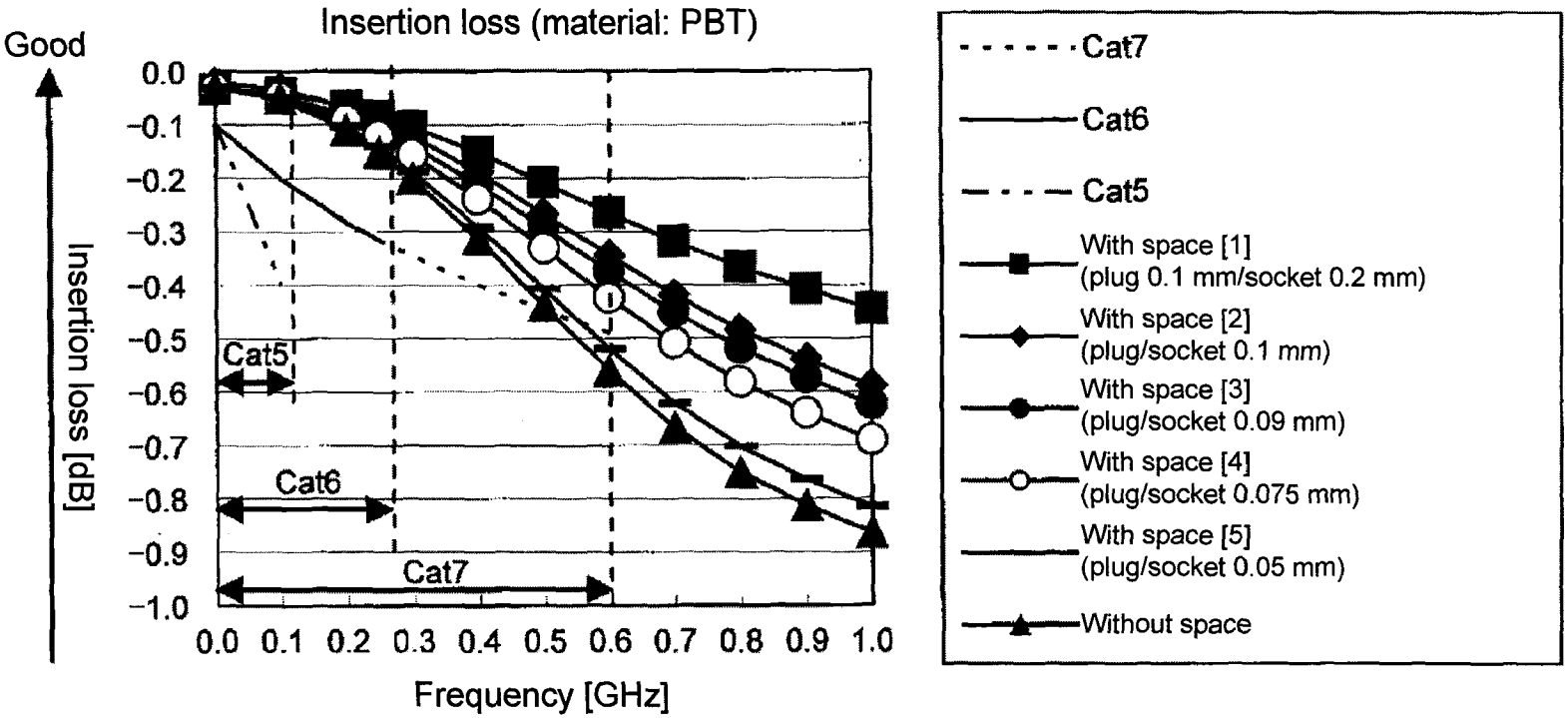
FIG. 13 is a graph illustrating the analysis result of the high frequency property of PBT.
Figure 14:
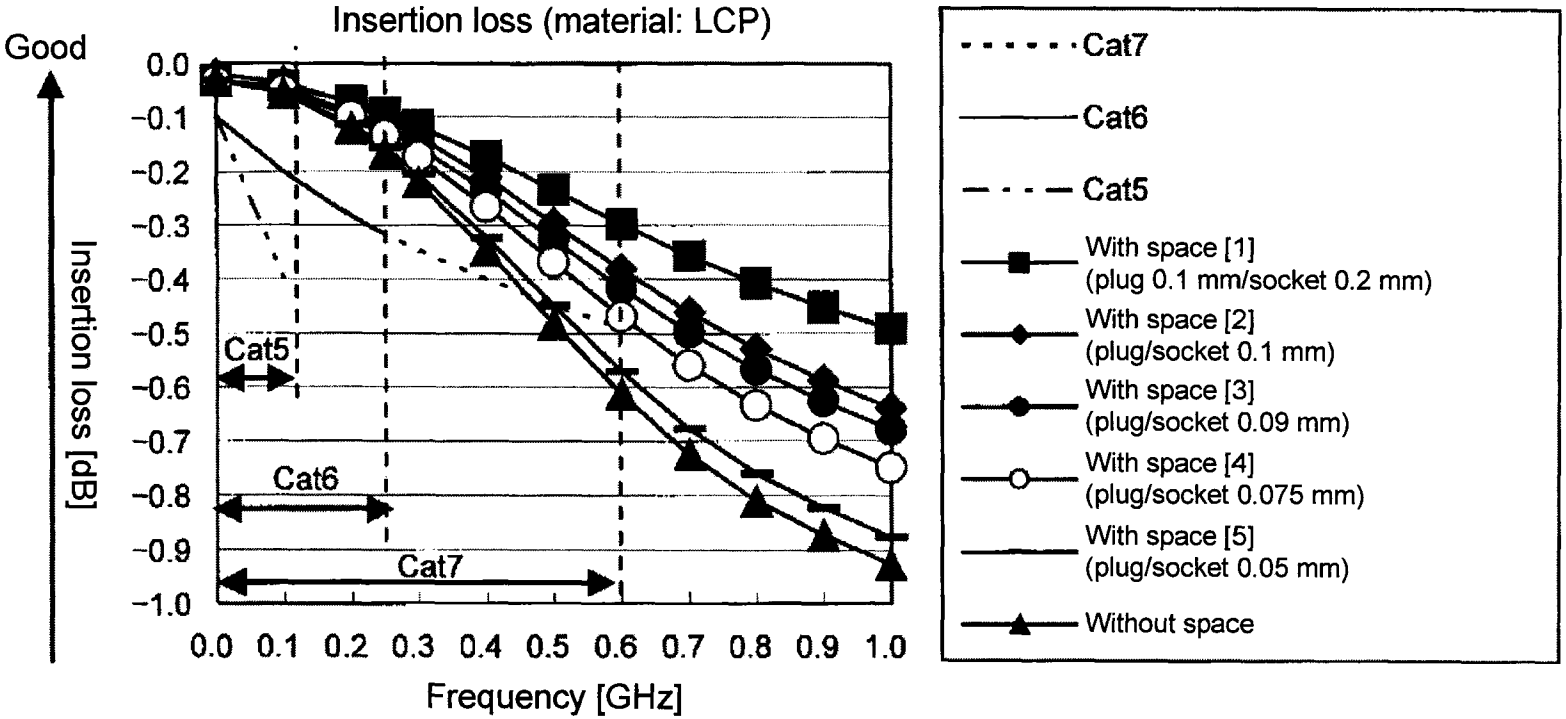
FIG. 14 is a graph illustrating the analysis result of the high frequency property of LCP.
Figure 15:
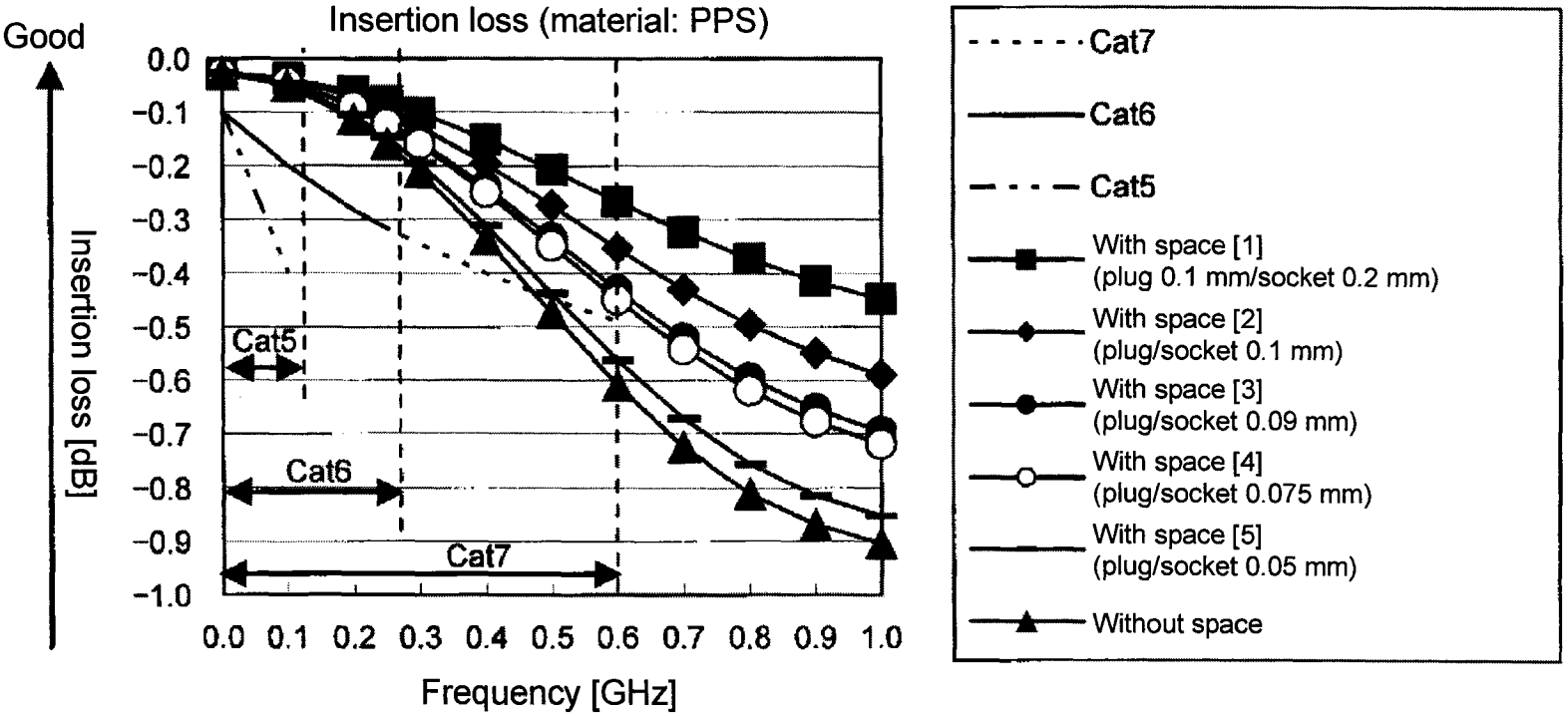
FIG. 15 is a graph illustrating the analysis result of the high frequency property of PPS.

FIG. 12 illustrates tables of analysis results, and FIGS. 13 to 15 illustrate graphs of the detailed analysis results.

As illustrated in FIGS. 13 and 15, it is found that the insertion loss is less than or equal to the specification value of 0.49 dB to thus satisfy the requirement of category 7 when the dimension of the cylindrical air gap is greater than or equal to 0.075 mm even at a transmission frequency of 600 MHz.

Accordingly, it is clear that a desired high frequency property is obtained only by providing the cylindrical air gap having a thickness of 0.075 mm or more in the outer circumferential surface of the terminal transmission line.

Example 2

In a second exemplary connector according to the invention, the high frequency property was analyzed in the case that the plug terminals adjacent to each other were deviated by 1 mm in the axial center direction.

Figure 16:
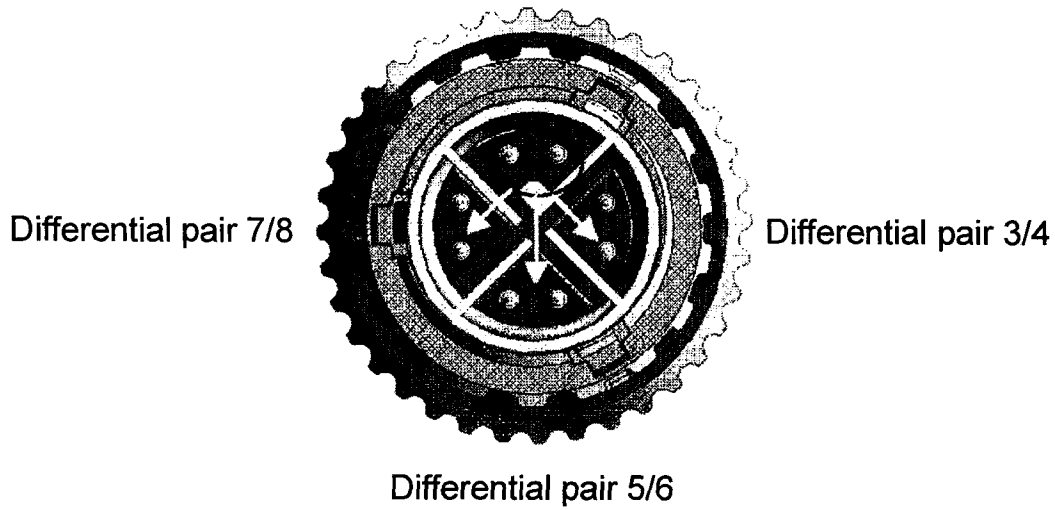
FIG. 16(A) is a view illustrating an analysis point.
FIG. 16(B) is an analysis result of the high frequency property.

As illustrated in FIG. 16(A), for example, it was assumed that equilibrium occurred where deviation did not exist in the axial center direction between a differential pair 1/2 and an adjacent differential pair 3/4, and it was assumed that non-equilibrium occurred where the deviation of 1 mm existed in the axial center direction between the differential pair 1/2 and the adjacent differential pair 3/4. A near-end crosstalk was analyzed at the transmission frequency of 600 MHz. Similarly, a relationship between the differential pair 1/2 and a differential pair 5/6 and a relationship between the differential pair 1/2 and a differential pair 7/86 were analyzed.

Whether the near-end crosstalk was smaller than a specification value in category 7 (the frequency band of 1 to 600 MHz) was analyzed based on a test standard of IEC 60512-25-1.

Figure 17:
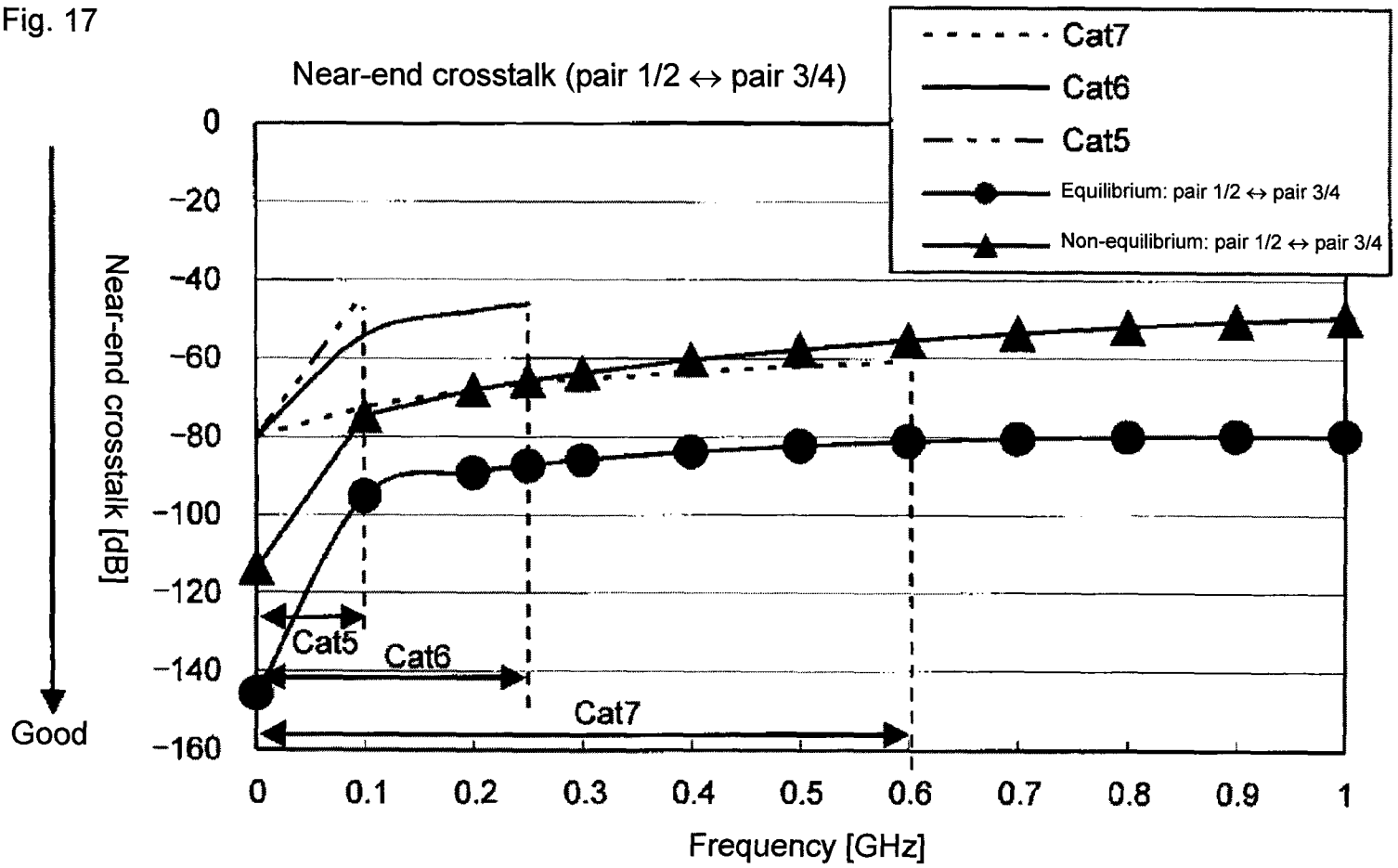
FIG. 17 is a graph illustrating an analysis result of a near-end crosstalk between a differential pair 1/2 and an adjacent differential pair 3/4.
Figure 18:
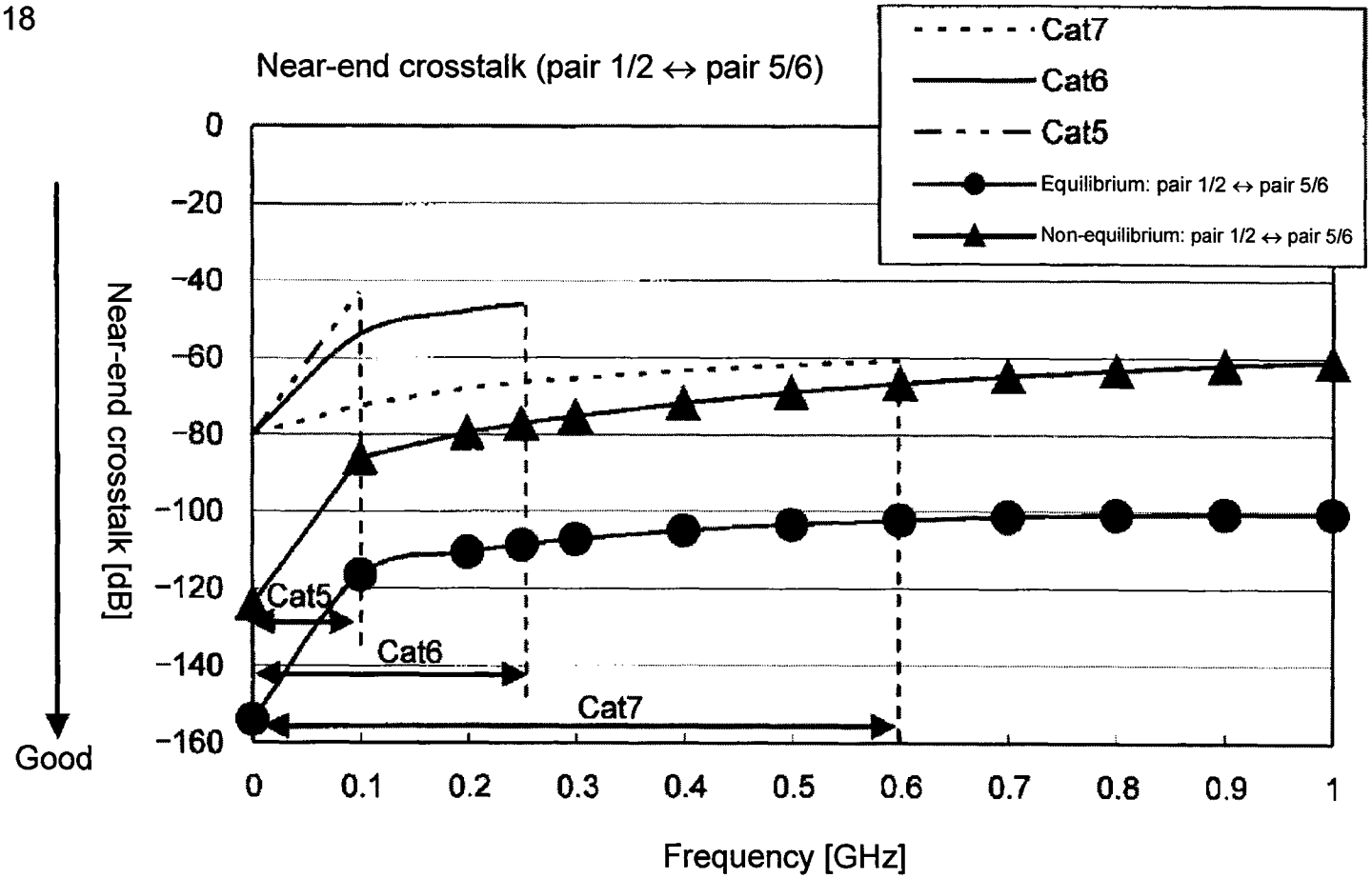
FIG. 18 is a graph illustrating the analysis result of the near-end crosstalk between the differential pair 1/2 and an adjacent differential pair 5/6.
Figure 19:
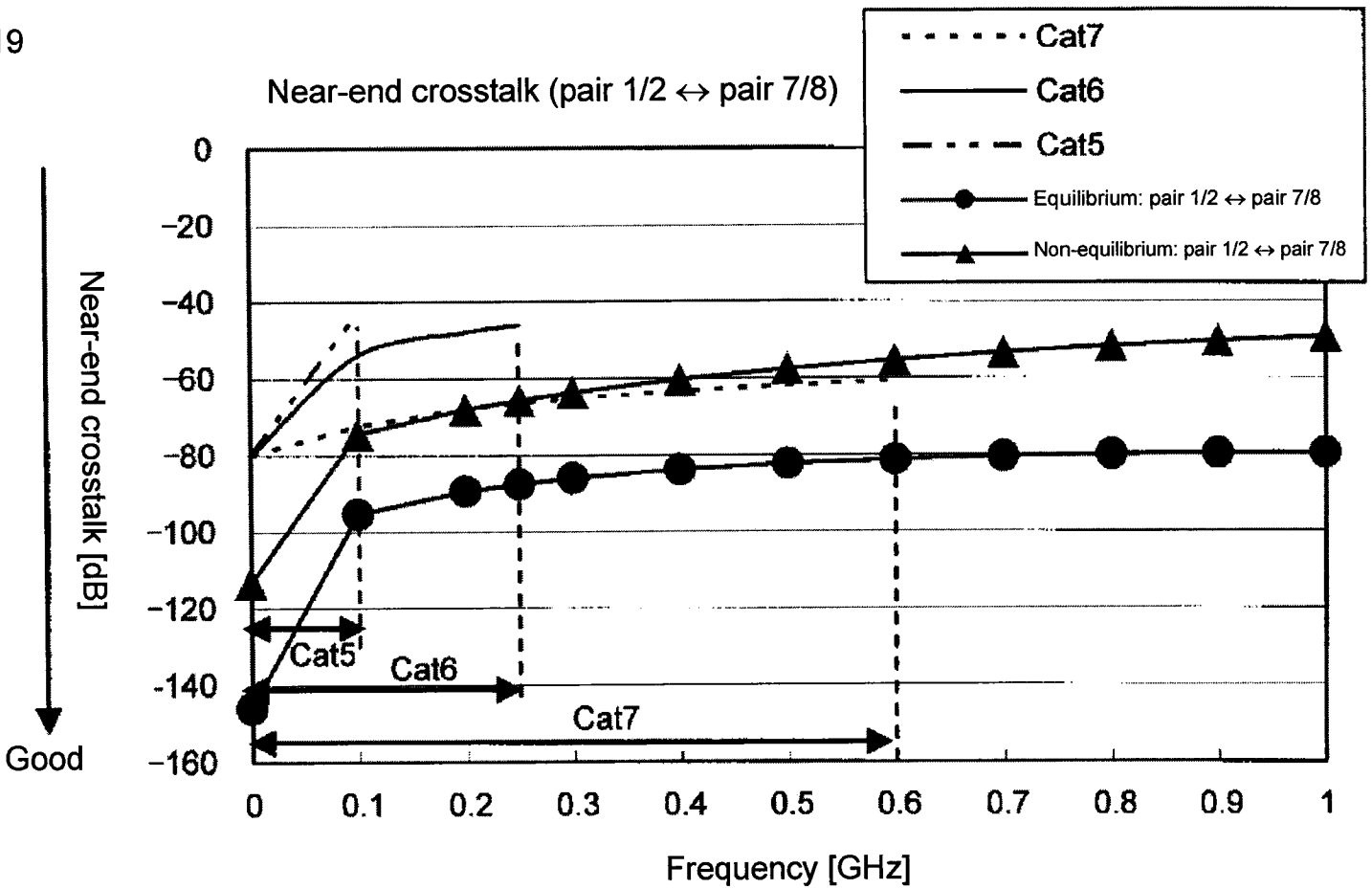
FIG. 19 is a graph illustrating the analysis result of the near-end crosstalk between a differential pair 1/2 and an adjacent differential pair 7/8.

FIG. 16(B) illustrates analysis results, and FIGS. 17 to 19 illustrate graphs of the detailed analysis results.

As illustrated in FIGS. 17 to 19, it is found that the requirement of category 7 is satisfied when the position deviation between the plug terminals adjacent to each other is less than 1 mm in the axial center direction even at a transmission frequency of 600 MHz.

Accordingly, it is clear that the desired high frequency property is obtained by eliminating the position deviation between the plug terminals in the axial center direction using the plug terminal holder.

In the connector of the present invention, the socket and the plug are directly electrically connected to each other on the identical axial center. Alternatively, for example, the present invention can also be applied to the case that the electric cable is connected to the socket which is previously fixed to the attaching plate with the plug interposed therebetween.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A connector, comprising:

a plug terminal of a plug connected to a first electric signal line and inserted in a terminal hole of a plug body;

a socket terminal of a socket connected to a second electric signal line and inserted in a terminal hole of a socket body;

a plug holder of the plug;

a socket holder of the socket; and a plug terminal holder having a terminal notch hole, wherein the plug holder and the socket holder are connected to each other, wherein the plug terminal is press fitted in and electrically connected to the socket terminal, the plug terminal holder is made of an insulating material, wherein a connection portion of the plug terminal is fitted and held axially in the terminal notch hole of the plug terminal holder, the connection portion of the plug terminal is configured to be electrically connected to the first electric signal line, and the plug terminal holder is configured to press the connection portion of the plug terminal onto a side of the plug body thereby eliminating movement of the plug terminal with respect to the plug terminal holder.

2. The connector according to claim 1, wherein one of the plug body and the socket body is made of at least one of polybutylene terephthalate, liquid crystal polymer, and polyphenylene sulfide.

3. The connector according to claim 1, wherein the plug terminal holder has an outer circumferential shape configured to fit in a fitting recess of the plug body.

4. The connector according to claim 1, wherein the connector includes multiple plug terminals and the plug terminal holder is provided with a set of terminal notch holes in which connection portions of the plug terminals are fitted and held axially.

5. The connector according to claim 4, wherein one of the plug body and the socket body is made of at least one of polybutylene terephthalate, liquid crystal polymer, and polyphenylene sulfide.

6. The connector according to claim 1, wherein a plurality of plug terminals contain portions that protrude from the plug body and include an equal protrusion length.

7. The connector according to claim 6, wherein one of the plug body and the socket body is made of at least one of polybutylene terephthalate, liquid crystal polymer, and polyphenylene sulfide.

8. A connector, comprising:

plug terminals of a plug connected to a first electric signal line and inserted in a terminal hole of a plug body;

socket terminals of a socket connected to a second electric signal line and inserted in a terminal hole of a socket body;

a plug holder of the plug;

a socket holder of the socket; and a plug terminal holder having terminal notch holes, wherein the plug holder and the socket holder are connected to each other, the plug terminals are press fitted in and electrically connected to the socket terminals, the plug terminal holder is made of an insulating material, a connection portion of each of the plug terminals is fitted and held axially in terminal notch holes of the plug terminal holder, the connection portions of each of the plug terminals are configured to be electrically connected to the first electric signal line, the plug terminal holder is configured to press the connection portion of each of the plug terminals onto a side of the plug body thereby eliminating movement of the plug terminals with respect to the plug holder, and the plug terminal holder is provided with a set of terminal notch holes in which the connection portions of the plug terminals are fitted and held axially.

9. The connector according to claim 8, wherein a plurality of plug terminals contain portions that protrude from the plug body and include an equal protrusion length.

10. The connector according to claim 8, wherein one of the plug body and the socket body is made of at least one of polybutylene terephthalate, liquid crystal polymer, and polyphenylene sulfide.

* * * * *